US005243904A

United States Patent [19]

Hayama et al.

[11] Patent Number: 5,243,904

[45] Date of Patent: Sep. 14, 1993

[54] STENCIL PRINTING WITH NO BACK CONTAMINATION

[75] Inventors: Noboru Hayama; Yoshiharu Ohinata, both of Tokyo, Japan

[73] Assignee: Riso Kagaku Corporation, Tokyo, Japan

[21] Appl. No.: 887,842

[22] Filed: May 26, 1992

[30] Foreign Application Priority Data

Jun. 6, 1991 [JP] Japan ..... 3-162218

[51] Int. Cl.[5] ..... B41L 13/04

[52] U.S. Cl. ..... 101/120; 101/124; 101/116

[58] Field of Search ..... 101/120, 119, 118, 117, 101/116, 124, 129

[56] References Cited

U.S. PATENT DOCUMENTS

| | | | |
|---|---|---|---|
| 2,606,492 | 8/1952 | Black | 101/124 |
| 2,852,252 | 9/1958 | Sperry | 101/120 X |
| 3,120,180 | 2/1964 | Black et al. | 101/124 |
| 3,139,823 | 7/1964 | Landesman | 101/124 |
| 3,283,710 | 11/1966 | Zahradnik et al. | 101/118 X |
| 3,536,005 | 10/1970 | Derrickson | 101/129 |
| 4,245,554 | 1/1981 | Kammann et al. | 101/124 |
| 4,911,069 | 3/1990 | Hayama et al. | 101/120 |
| 5,060,567 | 10/1991 | Hayama et al. | 101/120 |

FOREIGN PATENT DOCUMENTS

| | | |
|---|---|---|
| 6607408 | 1/1968 | Australia . |
| 0003983 | 9/1979 | European Pat. Off. . |
| 0095819 | 12/1983 | European Pat. Off. . |
| 0281704 | 9/1988 | European Pat. Off. . |
| 3903721 | 8/1989 | Fed. Rep. of Germany . |
| 58-160152 | 10/1983 | Japan . |
| 59-143679 | 8/1984 | Japan . |
| 60-165347 | 11/1985 | Japan . |
| 1-204781 | 8/1989 | Japan . |
| 2-225078 | 9/1990 | Japan . |

*Primary Examiner*—Edgar S. Burr
*Assistant Examiner*—Lynn D. Hendrickson
*Attorney, Agent, or Firm*—Stevens, Davis, Miller & Mosher

[57] ABSTRACT

In a stencil printing including the steps of supplying ink in the form of a layer on one side of a perforated stencil sheet, contacting another side of the stencil sheet to a surface for printing, applying a pressure to the ink layer by a pressing means so as to transfer the ink of the ink layer through perforations of the stencil sheet from the one side to the other side of the stencil sheet and to attach the ink thus transferred onto the surface for printing, and detaching the surface for printing from the other side of the stencil sheet, the improvement is which the surface for printing is detached from the other side of the stencil sheet at a portion thereof where a movement of the ink layer relative to the stencil sheet is substantially impeded by the pressing means so that a drawing out of the ink from the ink layer onto the surface for printing due to the adhesiveness and viscosity of the ink does not occur when the surface for printing is detached from the stencil sheet, thus also allowing the extrusion of the ink through the stencil perforations to be expedited before the stencil sheet tightly contacts the printing surface, so as to avoid blank shadows of fibers of the stencil sheet, while avoiding the problem of back contamination.

1 Claim, 3 Drawing Sheets

Ir
Id
Ih
1a
1
2
3
4
S
T
F
P
V
Fa
Ig 1
1a
2
3
4
Ir
Id
Ih
Ig
Fa
S
T
F
P

STENCIL PRINTING WITH NO BACK CONTAMINATION

BACKGROUND OF THE INVENTION

1. Field of the Invention

The present invention relates to an improvement in stencil printing, and more particularly, to control of the transfer of ink through perforations of a stencil sheet.

2. Description of the Prior Art

The stencil printing comprises the steps of supplying ink in the form of a layer on a first surface of a perforated stencil sheet, and applying a pressure to the ink layer so as to transfer the ink through perforations of the stencil sheet from a first side thereof facing said first surface to a second side thereof facing a second surface opposite to said first surface and to attach the ink thus transferred through the perforations of the stencil sheet onto a surface for printing.

A great difference in stencil printing from other printing arts such as anastatic printing, intaglio printing or offset printing is in that the ink is continuously supplied with no distinct division for each of a number of printings (or a number of print sheets) produced in succession. In other words, in stencil printing, the amount of ink supplied on one surface of a perforated stencil sheet in the form of a layer is not so small as to be exhausted by one time printing (or one sheet printing) but generally is adequate so as to be enough to print several times (or several print sheets). Particularly in stencil printing using a less fluidal ink, getting more popular these years, the ink layer supplied on one surface of a perforated stencil sheet is often so thick as to afford more than ten or sometimes hundreds of prints without replenishment of the supply of ink in the meantime.

Thus, stencil printing is carried out by supplying an ink layer having a capacity of printing tens to hundreds of prints on a first surface of a perforated stencil sheet, contacting a second surface opposite to said first surface of the stencil sheet with a surface for printing, applying a pressure to the ink layer by a pressing means so as to transfer the ink of the ink layer through perforations of the stencil sheet from a first side thereof facing said first surface toward a second side thereof facing said second surface, attaching the ink thus transferred onto the surface for printing, then releasing the pressure applied to the ink layer, and then detaching the surface for printing from the stencil sheet. In this case, the matter of how much ink is transferred from the ink layer onto the surface for printing as separated from the ink layer when the surface for printing is detached from the stencil sheet depends on the fluidity and the adhessiveness of the ink, the affinity between the ink and the surface for printing, the size of the perforations, etc. If the amount of transfer of the ink is too much, a blurring of the printed image occurs, while if the amount of transfer of the ink is too small, the printed image becomes dim.

When the stencil sheet is perforated by a thermal copying method according to which a thermo-sensitive stencil sheet including a thermoplastic film is laid over an original bearing black images containing carbon or the like which generates heat by absorbing infrared rays, and light beams rich in infrared rays are radiated onto the black images through the thermoplastic film, so that portions of the thermoplastic film corresponding to the black images are melted by the heat generated in the black image and form perforations following the black images of the original, the size of each perforation differs widely according to the size of the black images. Therefore, it is very difficult to optimize the fluidity and the adhessiveness of the ink to match the wide variety of the size of the perforation so that the amount of transfer of the ink through the perforation is placed under the control of the flow resistance applied to the throttling action by the perforation. Therefore, if the printed image is not be dim at a small perforation, the printed image would unavoidably show a tendency of blurring at a large perforation due to an excessive transfer of ink.

When such a thermo-sensitive stencil sheet is perforated by a dot matrix thermal perforation using a dot thermal head, each perforation formed in the stencil sheet generally has a substantially uniform size regardless of the size of the black portion of the image. However, even in this case, since the amount of transfer of the ink from the ink layer onto the surface for printing at each dot printing is determined according to the cutting condition of the ink from the continuous ink layer, if no dim portion is to occur at any portion of the entire image, it is unavoidable that the amount of transfer of the ink is generally adjusted to be larger than that in anastatic, intaglio or offset printing. Therefore, even in this case, when the printed sheets are stacked immediately after the printing, there is still the problem of the back contamination, although it is not so serious as in the case of the thermal copying stencil printing.

SUMMARY OF THE INVENTION

In view of the above-mentioned problems of the back contamination bound with stencil printing, it is the object of the present invention to provide an improved method of stencil printing which provides clear images of stencil printing without the problems of back contamination.

According to the present invention, the above-mentioned object is accomplished by a method of stencil printing comprising the steps of supplying ink in the form of a layer on a first surface of a perforated stencil sheet, contacting a second surface opposite to said first surface of said stencil sheet to a surface for printing, applying a pressure to said ink layer by a pressing means so as to transfer the ink of said ink layer through perforations of the stencil sheet from a first side thereof facing said first surface to a second side thereof facing said second surface and to attach the ink thus transferred onto the surface for printing, and detaching the surface for printing from said second surface of the stencil sheet, wherein the surface for printing is detached from said second surface of the stencil sheet at a portion thereof at which a movement of said ink layer relative to the stencil sheet is substantially impeded by said pressing means.

When the stencil printing is carried out by such steps that the ink is supplied in the form of a layer on a first surface of a perforated stencil sheet, a second surface opposite to said first surface of the stencil sheet is brought into contact with a surface for printing, a pressure is applied to the ink layer by a pressing means so as to transfer the ink of the ink layer through perforations of the stencil sheet from the side of said first surface to the side of said second surface and thereby to attach the ink thus transferred onto the surface for printing, and the surface for printing is detached from said second surface of the stencil sheet in a state that a movement of the ink layer relative to the stencil sheet is substantially impeded by the pressing means, when the surface for printing is detached from the stencil sheet, the ink of the ink layer is not drawn out from the ink layer toward the surface for printing even when the ink is applied with a drawing action due to the adhessiveness of the ink to the surface for printing and the viscosity of the ink, and therefore, the transfer of the ink from the ink layer through the perforations of the stencil sheet according to the drawing action during the detachment of the surface for printing from the stencil sheet does not occur, so that only a very small amount of ink directly attaching the surface for printing is transferred onto the surface for printing, the ink attachment layers thus formed on the surface for printing each showing a plane extension in an area corresponding to each of the perforations of the stencil sheet with a relatively thin and uniform thickness.

Since the ink is an incompressible fluidal material, the functions of applying a pressure to the ink layer and of thereafter substantially impeding the movement of the ink layer relative to the stencil sheet while the surface for printing is detached from said second surface of the stencil sheet are readily accomplished by pressing the ink layer directly by a rigid pressing means and then fixing the relative position between the stencil sheet and the pressing means while the surface for printing is detached from the stencil sheet. Or, on the contrary, when the volume of the space confined for the ink layer is increased by an opposite relative movement of the pressing means while the surface for printing is detached from the stencil sheet, a part of the ink once transferred through the perforations of the stencil sheet toward the surface for printing is inversely drawn toward the ink layer, whereby the avoidance of back contamination by the present invention is more effectively accomplished.

The method according to the present invention may be carried out in a rotary stencil printer in such a manner that the perforated stencil sheet is mounted around a printing drum having perforations to pass ink from an inside surface thereof to an outside surface thereof on which the perforated stencil sheet is carried with said first surface thereof facing thereto, the ink is supplied to the inside surface of said printing drum by an inking roller which also serves as said pressing means, said surface for printing is a surface of a sheet for printing, said second surface of the perforated stencil sheet is contacted to said surface of the sheet for printing by the sheet for printing being nipped between the perforated stencil sheet mounted around said printing drum and a back press roller disposed in parallel with said printing drum to provide a nip portion therebetween, and said surface of the sheet for printing is detached from said second surface of the perforated stencil sheet mounted around said printing drum at said portion thereof at which the movement of said ink layer relative to the stencil sheet is substantially impeded by said pressing means by the sheet for printing being moved along with said back press roller on an outlet side of said nip portion.

In this case, said pressure may be applied to said ink layer as starting before said second surface of the stencil sheet is in a substantial contact with the surface for printing.

The stencil printing method according to the present invention may be carried out by a rotary stencil printer comprising a printing drum having perforations for passing ink from an inside surface thereof to an outside surface thereof and adapted to rotate about a central axis thereof, a back press roller disposed in parallel with said printing drum to be rotatable about a central axis thereof and opposed to said outside surface of said printing drum so as to provide a nip portion therebetween, an inking roller disposed in parallel with said printing drum to be rotatable about a central axis thereof and opposed to said inside surface of said printing drum so as to supply ink to said inside surface of said printing drum and to press an ink layer supplied on said inside surface of said printing drum at said nip portion so as to transfer the ink of said ink layer through said perforations of said printing drum toward said outside surface of said printing drum, and a means for holding a sheet for printing as attached onto said back press roller on an outlet side of said nip portion.

In the above-mentioned rotary stencil printer, said means for holding the sheet for printing as attached onto said back press roller on the outlet side of said nip portion may comprise a flap provided on said back press roller to clamp a leading edge of the sheet for printing and a pair of press rollers adapted to press opposite side edge portions of the sheet for printing to said back press roller on the outlet side of said nip portion, or such a means may be a means to apply a vacuum to an inside of said back press roller on the outlet side of the sheet for printing to said back press roller on the outlet side of said nip portion.

BRIEF DESCRIPTION OF THE DRAWINGS

In the accompanying drawings.

DESCRIPTION OF THE PREFERRED EMBODIMENTS

Figure 1A:
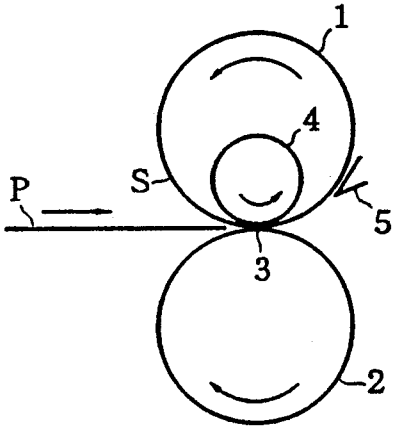
FIG. 1A PRIOR ART
FIGS. 1A-1D are a set of schematic views showing the conventional method of stencil printing as being carried out by a rotary type stencil printer.
Figure 1B:
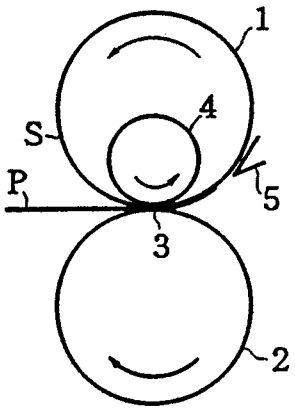
Figure 1C:
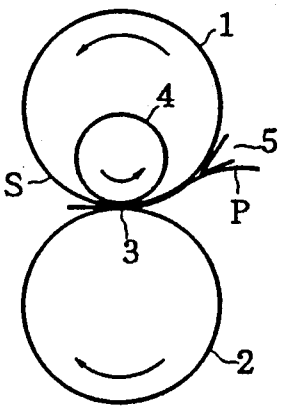
Figure 1D:
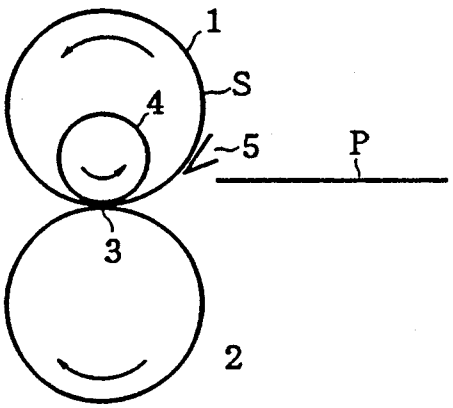
Figure 2A:
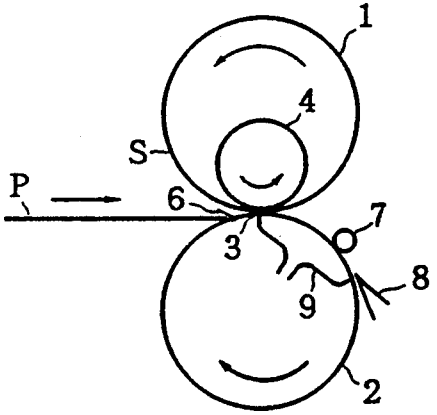
FIGS. 2A-2D are a set of schematic views similar to FIGS. 1A-1D, showing the method of stencil printing according to the present invention, as being carried out by a rotary type stencil printer, in comparison with the conventional method shown in FIGS. 1A-1D.
Figure 2B:
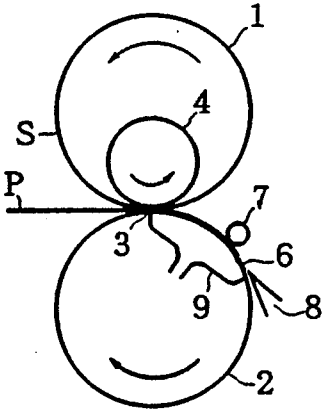
Figure 2C:
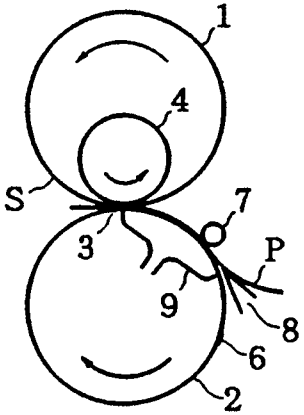
Figure 2D:
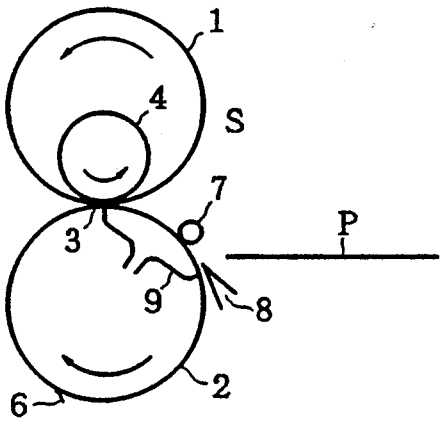

In the following, the present invention will be described in more detail in the form of some preferred embodiments with reference to the accompanying drawings.

In FIG. 1, figure-parts 1A, 1B, 1C and 1D show the processes successively performed by a rotary type stencil printer according to the conventional method of stencil printing. The conventional rotary type stencil printer generally comprises a printing drum 1 having a perforated cylindrical wall and adapted to rotate about a central axis thereof, and a back press roller 2 adapted to rotate about a central axis thereof and arranged in parallel with and to oppose the printing drum 1, so that a nip portion 3 for nipping a sheet for printing and applying a print image thereon is formed between the opposing outside cylindrical surfaces of the printing drum 1 and the back press roller 2. An inking roller 4 for supplying ink to the inside cylindrical surface of the printing drum 1 is provided inside of the printing drum to rotate about a central axis thereof. The inking roller 4 may be arranged to be shifted toward and away from the inside surface of the printing drum 1 in synchronization with the rotation of the printing drum 1, so as selectively to apply a printing pressure at the inside of the printing drum 1 at a portion opposing the nip portion 3 only when a printing area of a stencil sheet mounted around the printing drum 1 is positioned at the nip portion. Further, a detaching claw 5 is provided adjacent the outside cylindrical surface of the printing drum 1 for detaching the sheet for printing from the printing drum.

The printing by such a rotary type stencil printer starts from a process shown in figure-part 1A, wherein the printing drum 1 around which a perforated stencil sheet S is mounted, the back press roller 2 and the inking roller 4 are rotated about the respective central axes in the respective directions shown by the arrows, and a sheet for printing P is fed toward the nip portion 3. Then the printing process proceeds to the state shown in figure-part 1B, wherein the sheet for printing P is given on its upper surface the ink transferred through the perforations of the stencil sheet S in the nip portion 3, while in the meantime the sheet for printing P is transferred with a portion thereof bearing the ink given thereon being carried by the printing drum 1 as attached to the stencil sheet by the adhesion of the ink. Thereafter, when the printing process further proceeds, the leading edge of the sheet for printing P engages the detaching claw 5, and thereafter the sheet for printing P is gradually detached from the printing toward its trailing edge in accordance with the progress of the printing toward the rear portion of the sheet for printing, as shown in figure-part 1C, then finally to attain the state shown in figure-part 1D at the completion of the printing.

As compared with such a conventional rotary type stencil printer, the rotary type stencil printer embodying the present invention operates through the processes shown in FIG. 2, figure-parts 2A, 2B, 2C and 2D. In this case, the printer may have substantially the same construction as the conventional printer shown in FIG. 1 in its basic construction including the printing drum 1, the back press roller 2, the nip portion 3 and the inking roller 4. However, the back press roller 2 is provided with a means to hold the sheet for printing passed through the nip portion 3 on the side of the back press roller 2. In the shown embodiment, the means for holding the sheet for printing on the back press roller is a flap 6 provided at a portion of the outer wall of the back press roller 2 and adapted to clamp the leading edge of the sheet for printing P. Further, a pair of press rollers 7 are provided to face the outside cylindrical surface of the back press roller 2 at opposite axial end portions thereof as shown in the figure, so as to press opposite side edge portions of the sheet for printing P moving with the back press roller 2 as clamped by the flap 6 at the leading edge thereof against the back press roller 2. Further, a detaching claw 8 is provided adjacent the outside cylindrical surface of the back press roller 2 as shown in the figure.

In the printing by this rotary stencil printer, the printing process also starts from the state shown in figure-part 2A, wherein a perforated stencil sheet S is mounted around the printing drum 1, and the printing drum 1, the back press roller 2 and the inking roller 4 are rotated in the respective directions shown by the respective arrows, while the sheet for printing P is fed toward the nip portion 3. In this case, however, before the leading edge of the sheet for printing P enters the nip portion 3, the leading edge is fixed to the outer wall of the back press roller 2 by the flap 6, so that thereafter the sheet for printing P is transferred along with the back press roller 2. Therefore, in this case, after the sheet for printing P has been given on its upper surface ink image attachments according to the perforations of the stencil sheet, it is detached from the stencil sheet S at a region where the ink layer is still under the control of the inking roller 4, as described in more detail hereinunder.

When the printing proceeds to the state shown in figure-part 2B, the leading edge of the sheet for printing P is released from the clamping action by the flap 6. However, since the opposite side portions of the sheet for printing P are already pressed against the back press roller 2 by the press rollers 7, in spite of the release of the flap 6, the portion of the sheet for printing P having passed through the nip portion 3 continues to move as attached to the back press roller 2. Then, when the printing proceeds to the state shown in figure-part 2C, where the leading edge of the sheet for printing P engages the detaching claw 8, the sheet for printing P is detached from the back press roller 2, starting from the leading edge, while the remaining portion of the sheet for printing P is applied with printing, so as to finally attain the state shown in figure-part 2D, where the printing is completed.

Figures 3A, 3B, 3C, 3D, 4A, 4B, 4C, 4D:
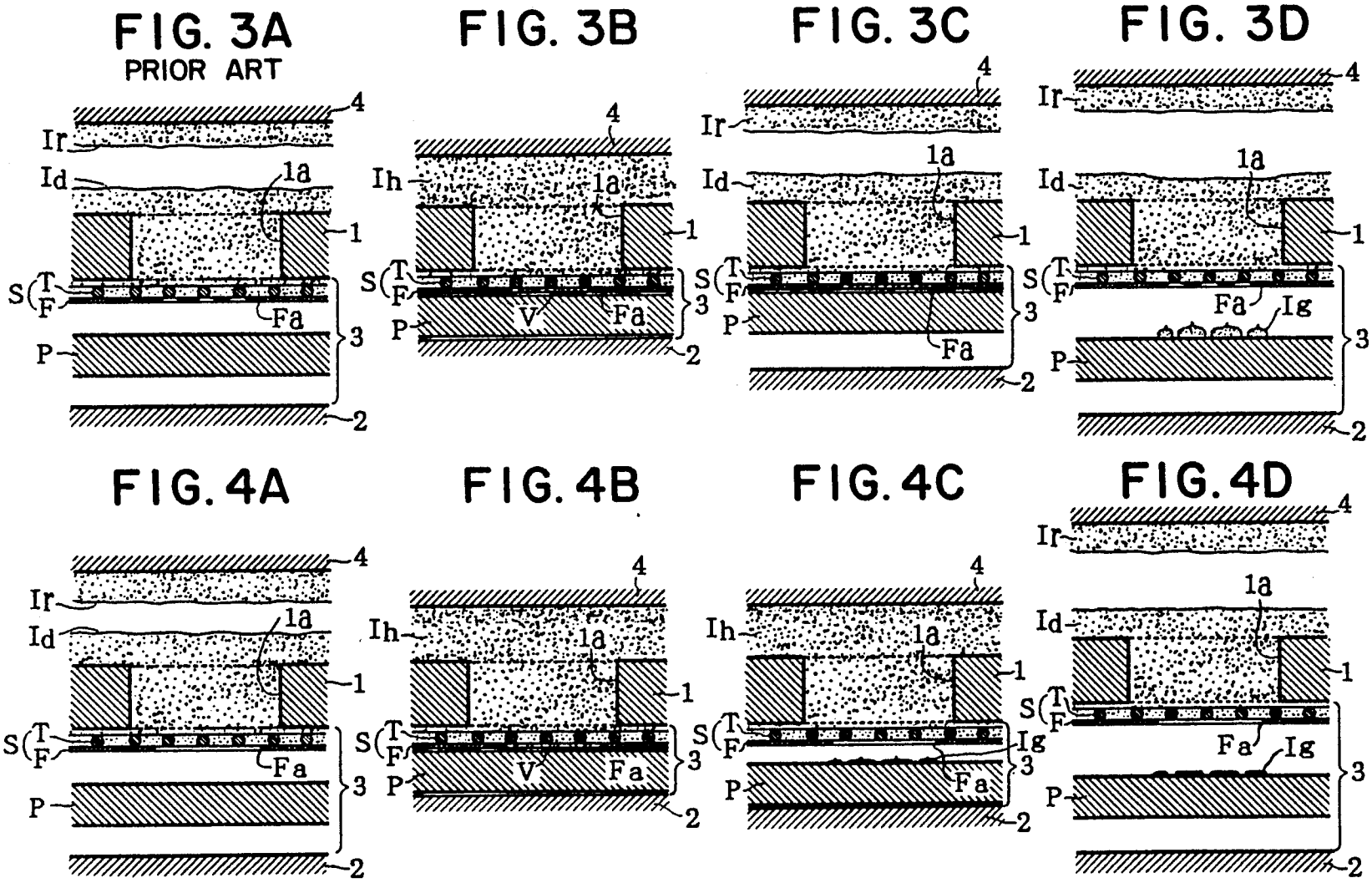
FIG. 3A PRIOR ART
FIGS. 3A-3D are a set of somewhat diagrammatic illustration showing the behavior of the ink around the perforation of the stencil sheet in the conventional method of stencil printing.
FIGS. 4A-4D are a set of somewhat diagrammatic illustration similar to FIGS. 3A-3D, showing the behavior of the ink around the perforation of the stencil sheet in the method of stencil printing according to the present invention, in comparison with the conventional method shown in FIGS. 3A-3D.

FIGS. 3 and 4 show somewhat schematically the behavior of the ink around a perforation of the stencil sheet in the conventional stencil printing shown in FIG. 1, figure-parts 1A–1D, and the stencil printing according to the present invention shown in FIG. 2, figure-parts 2A–2D, respectively. Figure-parts 3A–3D correspond to figure-parts 1A–1D, and figure-parts 4A–4D correspond to figure-parts 2A–2D.

In FIG. 3, figure-parts 3A–3D, corresponding to figure-parts 1A–1D of FIG. 1, the reference numerals 1–4 designate the printing drum, the back press roller, the nip portion and the inking roller, respectively. The printing drum 1 is formed with a number of small openings, one of which is shown by **1*a*. The stencil sheet S mounted around the printing drum is made of a perforated support sheet T which may be a Japanese paper or a net woven or knitted of fine fibers and a thermoplastic film F pasted to the perforated support sheet. The film F is formed with a perforation Fa. The sheet for printing P is positioned between the film F of the stencil sheet and the back press roller 2 at the nip portion 3. The printing drum 1 is supplied with the ink layer Id on its inside cylindrical surface. This ink fills the space of the opening 1*a* and further partly the spaces among the fibers of the perforated support sheet T of the stencil sheet S as well as partly the perforation Fa of the film F. An ink layer Ir is held on the outer surface of the inking roller 4**.

The contact between the cylindrical stencil sheet S wrapped around the printing drum 1 and the sheet for printing P changing from a generally plane shape to the cylindrical shape following the back press roller 2 is theoretically a line contact along a generatrix of a cylindrical body. However, since the stencil sheet S and the sheet for printing P are both somewhat flexible, the contact between these two mutually contacting surfaces is actually a band contact having a certain narrow width which is dependent upon such factors as the flexibility of the stencil sheet and of the sheet for printing, the radius of the printing drum 1, the radius of the back press roller 2 and the force of compression between the stencil sheet and the sheet for printing. In the state shown in FIG. 3, figure-part 3A, around the perforation Fa of the stencil sheet, the inking roller is not yet in contact with the printing drum 1, and the sheet for printing P is also not yet in contact with the stencil sheet.

When the sheet for printing P further proceeds in the nip portion 3, the sheet for printing P contacts the film F of the stencil sheet S, and at the same time an ink layer Ir carried on the inking roller 4 and the ink layer Id supplied on the printing drum 1 join as shown in figure-part 3B to form an ink layer Ih, and as the outside surface of the inking roller 4 further approaches the inside surface of the printing drum 1, the ink contained in the space between the inking roller 4 and the stencil sheet S is compressed, so that the ink is extruded out through the perforation Fa toward the surface of the sheet for printing P. In this case, when the sheet for printing P contacts the film F of the stencil sheet S before the compression of the ink layer by the inking roller 4 proceeds so much that the ink extruded through the spaces among the fibers of the perforated support sheet T turns around the fibers enough to fill the spaces behind the fibers, some vacant spaces V will be left at which blank shadows of the fibers are formed in the printed images. However, such blank shadows can be avoided, if desired, by expediting the extrusion of the ink through the perforation Fa relative to the time point at which the film F and the sheet for printing P come into a substantial contact with one another, as described later, while ensuring the suppression of the back contamination.

Thereafter, in the conventional stencil printing, the sheet for printing P moves together with the stencil sheet S as attached thereto, as shown in FIG. 1, figure-part 1C, and in the meantime the inking roller 4 departs from the inside surface of the printing drum 1. Therefore, as shown in FIG. 3, figure-part 3C, the ink layer filling the perforation Fa is maintained as attached to the sheet for printing P, while the inside surface of the ink layer Id on the printing drum is exposed to the atmosphere. Thereafter, when the sheet for printing P is detached from the stencil sheet S, the ink layer is expanded as adhered to the sheet for printing P, so that the ink layer Id moves relatively readily through the perforation Fa of the stencil sheet, and therefore relatively thick ink attachment layers Ig are provided on the sheet for printing P, when the ink masses expanded through the openings among the fibers of the stencil sheet have been disconnected, as shown in figure-part 3D. These relatively thick ink attachment layers cause the back contamination.

As compared with the above, FIG. 4, figure-parts 4A–4D, show the behavior of the ink in the printing method according to the present invention carried out in the manner shown in FIG. 2, figure-parts 2A–2D, in comparison with that shown in FIG. 3, figure-parts 3A–3D. In this case, conditions up to figure-part 4B are the same as the above conventional method. However, according to the method of stencil printing of the present invention, as shown in figure-part 4C, the sheet for printing P is detached from the stencil sheet S when the inside surface of the ink layer Id on the printing drum 1 is not yet released from the inking roller 4, or in other words, when a movement of the ink layer Ih relative to the printing drum 1 and stencil sheet S is impeded as the incompressible ink layer is confined between the printing drum 1 and the inking roller 4.

When the nip portion 3 is magnified to show the details around the minute perforation Fa as illustrated in FIGS. 3 and 4, the inside and outside surfaces of the cylindrical printing drum 1, the outside surface of the back press roller 2, the outside surface of the inking roller 4, and the section of the stencil sheet S wrapped around the printing drum 1 would be approximated by straight contour lines as illustrated in FIGS. 3 and 4.

However, when viewed in a less magnified scale, the direct contact between the stencil sheet S and the sheet for printing P at the nip portion 3 shows a relatively small band width of contact, and on the other hand, the ink layer positioned between the inside cylindrical surface of the printing drum 1 and the outside surface of the inking roller 4 at the nip portion 3 is in a condition substantially sandwiched between the printing drum 1 and the inking roller 4 so that the movement of the ink is under the control of the movement of the inking roller 4 relative to the printing drum 1 over a band region, the width of which is dependent upon such factors as the difference between the radius of the inside cylindrical surface of the printing drum 1 and the radius of the outside cylindrical surface of the inking roller 4, the minimum clearance between the inside cylindrical surface of the printing drum 1 and the outside cylindrical surface of the inking roller 4, and the thickness of the ink layer Ih existing between the inside surface of the printing drum 1 and the outside surface of the inking roller 4, and since the thickness of the ink layer Ih is relatively thick as compared with the stencil sheet or the sheet for printing, in spite of the construction that the radius of the inking roller 4 is approximately a half of that of the printing drum 1, the band region in which the movement of the layer of the ink, which is relatively highly viscous as viewed in a minute scale concerned with the perforations formed in the stencil sheet, is under the control of the relative movement between the printing drum 1 and the inking roller 4 is generally wider than the band area in which the stencil sheet and the sheet for printing are in the direct contact with one another at the nip portion 3.

Therefore, when the sheet for printing P has been given the ink image attachments according to the perforations of the stencil sheet in the band contact area between the cylindrical surface of the stencil sheet S and the cylindrical surface of the sheet for printing P at the nip portion 3, and then moves out of the nip portion 3 along with the back press roller 2 as attached thereto, the sheet for printing is so early detached from the stencil sheet at a position where the ink layer Ih filling the ink supply side of the stencil sheets is not yet released from the movement control by the inking roller 4.

Therefore, when the sheet for printing P is being detached from the stencil sheet S, even if the ink of the ink layer Ih would move toward the sheet for printing P due to the adhesion of the ink to the surface of the sheet for printing P and the viscosity of the ink, the incompressible ink filling a space confined by the rigid wall of the inking roller around the perforation Fa can not expand. Since the ink has a relatively high viscosity, the ink around this confined space region can not flow into this region in a short time. Therefore, the ink can not move to follow the departing sheet for printing. Or rather on the contrary, the space confined by the rigid wall of the inking roller 4 is going to expand toward the end of the band region, because the clearance between the inside cylindrical surface of the printing drum 1 and the cylindrical outside surface of the inking roller 4 increases toward the end of the band region, and therefore the ink in the perforation Fa tends to be drawn into the confined space region. Therefore, relatively thin ink attachment layers Ig are provided on the sheet for printing P, wherein the thickness of each of these ink attachment layers is determined by the affinity between the ink and the sheet for printing P and is not affected by the size of the perforation. Thus, the ink attachment layers provided on the sheet for printing are strongly held thereon by the affinity between the ink and the sheet for printing, and therefore even when an upper sheet of printing is softly placed on the printed surface of a lower sheet for printing, even when the sheet for printing is of the same kind, no back contamination will occur.

Thus, after the sheet for printing P has been detached from the stencil sheet S with the ink attachment layers Ig attached thereon which are very thin but faithful to the perforation Fa in its plane configuration, as shown in figure-part 4D, the inking roller 4 departs from the printing drum 1 so as to expose the inside surface of the ink layer Id carried on the printing drum 1 to the atmosphere.

Figures 5A, 5B, 5C, 5D, 6A, 6B, 6C, 6D:
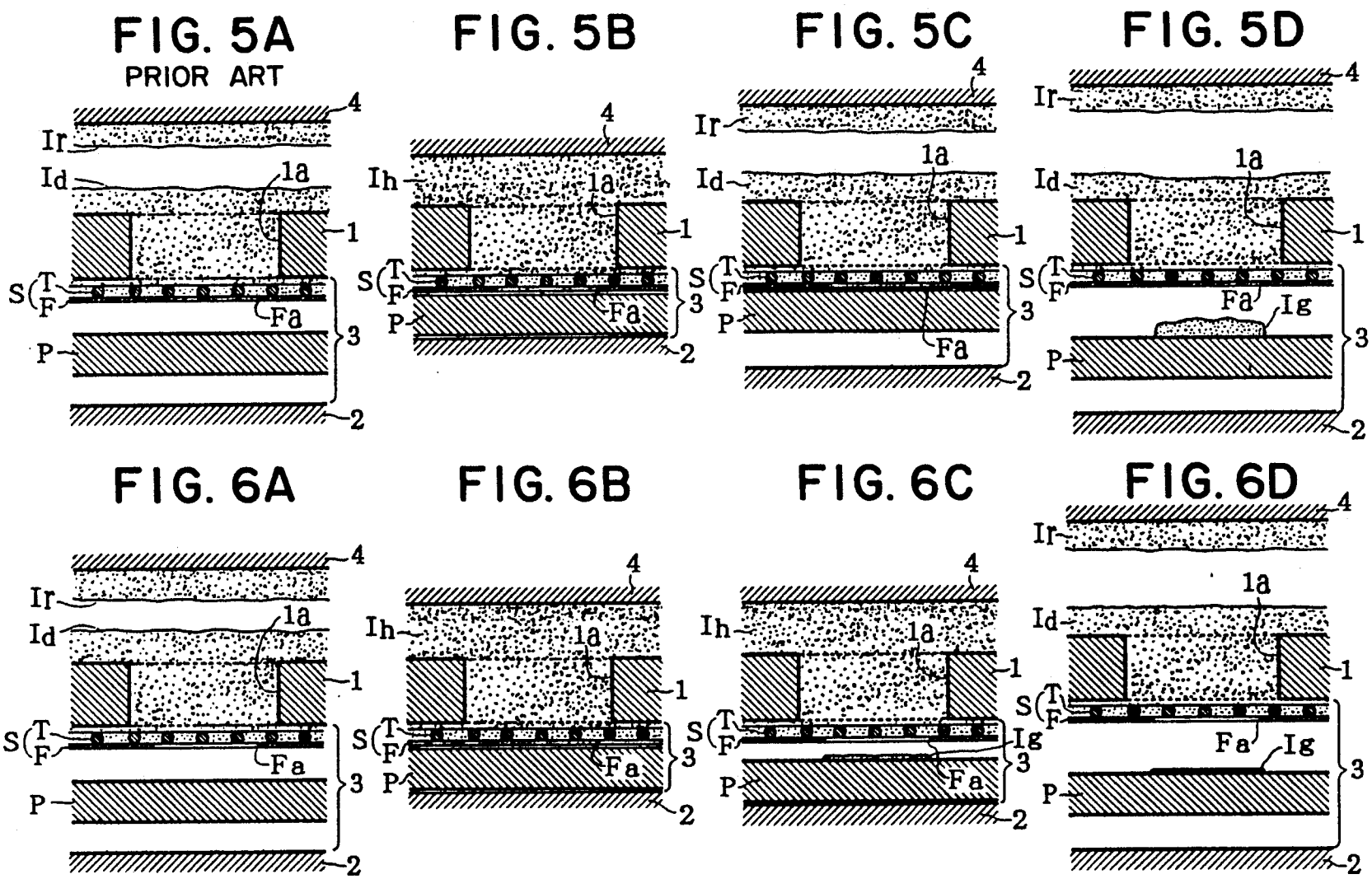
FIG. 5A PRIOR ART
FIGS. 5A-5D is a set of views similar to and corresponding to FIGS. 3A-3D, showing a modification with respect to the manner of forming ink image, attachments on the sheet for printing in the processes shown in FIGS. 3A-3D.
FIGS. 6A-6D are a set of views similar to and corresponding to FIGS. 4A-4D, showing a modification with respect to the manner of forming ink image attachments on the sheet for printing in the processes shown in FIGS. 4A-4D.

FIGS. 5 and 6 are views similar and corresponding to FIGS. 3 and 4, respectively, showing the comparison between the conventional method and the method according to the present invention, when the blank shadows of the fibers due to the vacant spaces V absent of the ink are avoided. As was described above, the vacant spaces V are left absent of the ink when the film F of the stencil sheet and the sheet for printing P are tightly pressed against one another before the ink of the ink layer supplied on the inside surface of the printing drum 1 is extruded through the spaces among the fibers of the perforated support sheet T of the stencil sheet enough to turn around the fibers and fill the spaces behind the fibers. Therefore, such blank shadows will be avoided by somewhat expediting the extrusion of the ink relative to the approaching action of the stencil sheet and the sheet for printing by increasing the thickness of the ink layer Id or Ir or both, or by shifting the inking roller 4 relative to the nip portion 3 on the upstream side as viewed in the direction of feed of the sheet for printing P, within a range of ensuring the condition that the above-mentioned band region of the ink layer whose relative movement is placed under the control of the inking roller 4 does not end before the sheet for printing P is detached from the stencil sheet S.

However, when the extrusion of the ink is so expedited in the conventional method that the ink image attachment Ig becomes a continuous mass extending over the entire area of the perforation Fa, the overall thickness of the ink image attachment Ig which is largely determined by the adhessiveness and viscosity of the ink in the conventional method would become more excessive as illustrated in FIG. 5, figure-part 5D.

In contrast, in the method according to the present invention, the thickness of the ink image attachment Ig is determined substantially only by the adhessiveness of the ink to the sheet for printing. Therefore, even when the ink image attachment Ig is formed to extend continuously over the entire area of the perforation Fa, the ink image attachment Ig has a relatively small thickness substantially determined by the adhessiveness of the ink to the sheet for printing, as illustrated in FIG. 6, figure-part 6D.

Although the present invention has been described in detail with respect to the preferred embodiments thereof, it will be apparent to those skilled in the art that various modifications are possible within the scope of the present invention. For example, the means for holding the sheet for printing P on the outside surface of the back press roller 2 on the outlet side of the nip portion 3 may be a vacuum device disposed inside of the back press roller, only a funnel portion of which is shown by 9 in FIG. 2, so as to hold the sheet for printing P on the outside surface of the back press roller 2 due to a vacuum generated within the back press roller 2. Such a vacuum device will be readily designed in various constructions employing the well known vacuum attraction techniques.

We claim:

1. A rotary stencil printer comprising a printing drum having perforations for passing ink from an inside surface thereof to an outside surface thereof and mounted for rotation about a central axis thereof, a back press roller disposed in parallel with said printing drum to be rotatable about a central axis thereof and opposed to said outside surface of said printing drum so as to provide a nip portion therebetween, an inking roller disposed in parallel with said printing drum to be rotatable about a central axis thereof and opposed to said inside surface of said printing drum so as to supply ink to said inside surface of said printing drum and to press an ink layer supplied on said inside surface of said printing drum at said nip portion so as to transfer the ink of said ink layer through said perforations of said printing drum toward said outside surface of said printing drum, and a means for holding a sheet for printing attached to said back press roller on an outlet side of said nip portion, said means for holding the sheet for printing comprising a flap provided on said back press roller to clamp a leading edge of the sheet for printing and at least one press roller positioned to press at least one side edge portion of the sheet for printing to said back press roller on the outlet side of said nip portion.

* * * * *